US007597365B2

(12) United States Patent
Kreitzer

(10) Patent No.: US 7,597,365 B2
(45) Date of Patent: Oct. 6, 2009

(54) GRAVITY OPERATED LOCKING MECHANISM FOR CONTAINERS

(75) Inventor: Joseph D. Kreitzer, Knoxville, TN (US)

(73) Assignee: Laser Blanks, LLC, Knoxville, TN (US)

( * ) Notice: Subject to any disclaimer, the term of this patent is extended or adjusted under 35 U.S.C. 154(b) by 0 days.

(21) Appl. No.: 11/867,406

(22) Filed: Oct. 4, 2007

(65) Prior Publication Data

US 2009/0091141 A1 Apr. 9, 2009

(51) Int. Cl.
*E05C 1/04* (2006.01)

(52) U.S. Cl. ..... 292/148; 292/230; 292/231

(58) Field of Classification Search ..... 292/148, 292/230, 231, 210, DIG. 4, 205, 239; 70/159, 70/164, 58, 54, 63; 220/315, 908
See application file for complete search history.

(56) References Cited

U.S. PATENT DOCUMENTS 5,094,358 A * 3/1992 Serio, Sr. ..... 220/315
5,118,000 A * 6/1992 Howell et al. ..... 220/315
5,415,314 A * 5/1995 McCollum ..... 220/315
6,666,485 B1 * 12/2003 Moret ..... 292/130

OTHER PUBLICATIONS

Catalog pages for PRT Conversion Lock—Apr. 21, 2005, 2 pages.

* cited by examiner

*Primary Examiner*—Peter M. Cuomo
*Assistant Examiner*—Mark Williams
(74) *Attorney, Agent, or Firm*—Luedeka, Neely & Graham, PC

(57) ABSTRACT

The present disclosure relates to automatic gravity actuated container lid locking mechanisms for bulk trash containers, wherein the mechanism comprises a counterweighted actuator arm pivotally attached to a first housing affixed to a first sidewall of the container, a crossbar across the lid of the container, and a dummy arm pivotally attached to a second housing affixed to a second sidewall of the container. The crossbar may pivot forward to unlock the lid when the container is tilted up for dumping. Alternatively, the crossbar may be pivoted forward when the lock is manually unlocked by sliding a counterweighted pin assembly on the first housing from a position interfering with the motion of the actuator arm to a position allowing the motion of the actuator arm.

15 Claims, 8 Drawing Sheets

GRAVITY OPERATED LOCKING MECHANISM FOR CONTAINERS

TECHNICAL FIELD

The disclosure relates to locking mechanisms and in particular, gravity actuated locking mechanisms for bulk trash containers having a hinged lid.

BACKGROUND AND SUMMARY

Bulk trash containers or bins, also commonly referred to as "dumpsters," are large bins constructed from a material such as heavy duty metal and equipped with a hinged lid. Refuse may be deposited within the containers, and the refuse may periodically be emptied from the container via a specialized truck equipped with a mechanical bin lifting and dumping mechanism, whereby the bin is lifted up and tilted over a hopper on the truck in order to empty the bin of refuse. The bin may then be tilted back into an upright position and lowered into position on the ground. The truck may continue on to the next such bin, and so on until the hopper is filled up. The refuse may then be transported on the truck to a refuse collection facility for further processing.

It is desirable for bulk trash container bins to have locks on the lids to prevent unauthorized access to the refuse bin while the bin is upright and on the ground. However, the locks must be constructed so as not to interfere with the lifting and dumping mechanism of the refuse trucks. For this reason, it is desirable that the locks have a low profile, meaning that the locking mechanism remains near to the dumpster body during locking and unlocking. It is also desirable that the lock mechanism automatically unlock as the bin is tilted over the truck, so that a person is not required to manually unlock the container prior to dumping and then relock the container following dumping. The locks also desirably include a manual unlocking mechanism so that the lid can be lifted by authorized personnel while the trash container is on the ground.

With regard to the foregoing, one embodiment of the disclosure provides a low profile locking mechanism for a refuse container lid. The mechanism includes an enclosed first housing for mounting on a side wall of a refuse container. The enclosed first housing includes an actuator arm extending from a top wall of the first housing, the actuator arm has a first counterweighted end, a first locking bar end opposite the first counterweighted end, a first pivot opening for pivotal rotation about a first shaft, and a locking tab offset from the first pivot opening between the counterweighted end and the locking bar end. The enclosed first housing further includes a second shaft disposed through the housing. The second shaft is capable of both rotational movement about an axis and translational movement along the axis. An L-shaped locking arm is enclosed in the housing and is pivotally attached to the second shaft for engaging the locking tab. The locking arm has a first end, a second end distal from the first end, and a second pivot opening between the first end and the second end. The locking arm may be pivoted by gravity about the second shaft from a locked position to an unlocked position upon tilting the container at least about 25 degrees.

In a further embodiment, the disclosure describes a gravity operated trigger lock mechanism for locking a refuse container lid. The trigger lock mechanism includes a first housing attached to a first side wall of the container. The first housing includes an actuator arm pivotally attached to the housing and a gravity operated trigger mechanism pivotally disposed in the housing for engaging a tab on the actuator arm. The mechanism also includes a second housing attached to an opposing side wall of the container and including a pivot arm attached to the housing. A locking bar is attached to the actuator arm and the pivot arm so that the locking bar is disposed over a portion of the lid in a locked position and is disposed forward of the lid in an unlocked position.

In still another embodiment, the present disclosure describes a gravity operated container lid hold down device. The device includes a first housing structure attached to a first side wall of the container. The first housing structure includes an actuator means for pivotal movement on a first shaft attached to the first housing structure between a lid hold down position and a lid opening position. The first housing structure also includes a trigger means having pivotal movement on a second shaft disposed through the housing for permitting movement of the actuator means from the lid hold down position to the lid opening position as the container is tilted. A second housing structure is attached to a second side wall of the container. The second housing structure includes a dummy actuator means for pivotal movement on a third shaft attached to the second housing structure between the lid hold down position and the lid opening position. An elongate member means is attached to the actuator means and the dummy actuator means so that the elongate member is disposed from the first side of the container to the second side of the container across the lid.

An advantage of the present disclosure may be that the locking mechanism is able to automatically unlock during the dumping process, eliminating the need for manual unlocking and locking during dumping. Another advantage is that locking mechanism may be laterally displaced from an automatic locking position to a manual unlocking position that does not interfere with movement of the actuator arm of the locking mechanism.

Additional objects and advantages of the disclosed device will be set forth in part in the description which follows, and/or can be learned by practice of the disclosed embodiments. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

BRIEF DESCRIPTION OF THE DRAWINGS

Further advantages of the exemplary embodiments will become apparent by reference to the detailed description when considered in conjunction with the figures, which are not to scale, wherein like reference numbers indicate like elements through the several views, and wherein.

DETAILED DESCRIPTION

The present disclosure will now be described in the more limited aspects of preferred embodiments thereof, including various examples and illustrations of the construction and use of the present disclosure. It will be understood that these embodiments are presented solely for the purpose of illustrating the invention and shall not be considered as a limitation upon the scope thereof.

In order to better understand the following detailed description of the present disclosure, it would be helpful to begin with a general description of a generic bulk trash container suitable for use with embodiments of the present disclosure. It should be noted, however, that embodiments of the present disclosure may be used with many types of containers, without being limited in any manner to the example container described below. The description of the example container is provided here solely to clarify aspects of the present disclosure.

Figure 1:
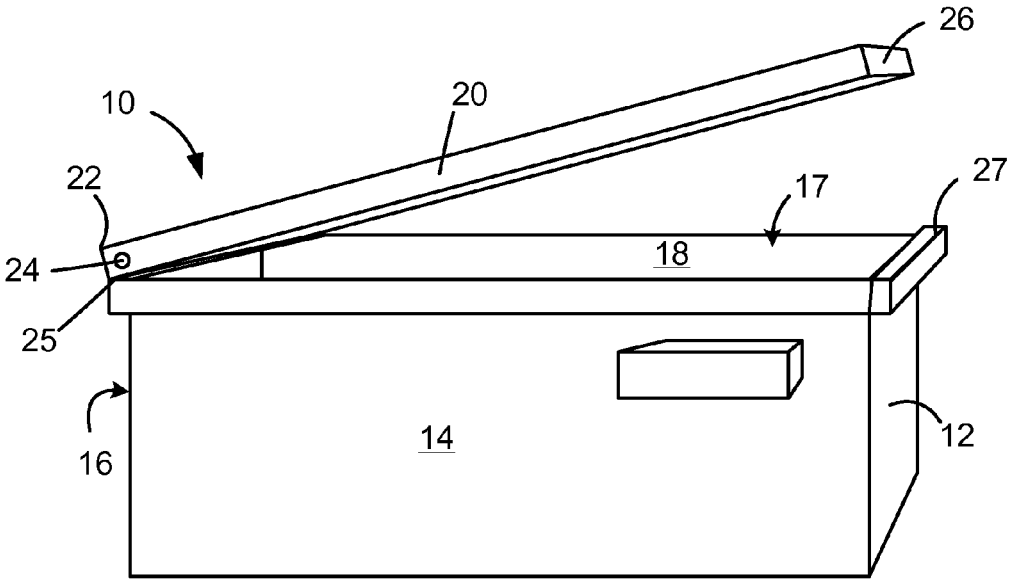
FIG. 1 is a perspective view, not to scale of a bulk trash container.
Figure 2:
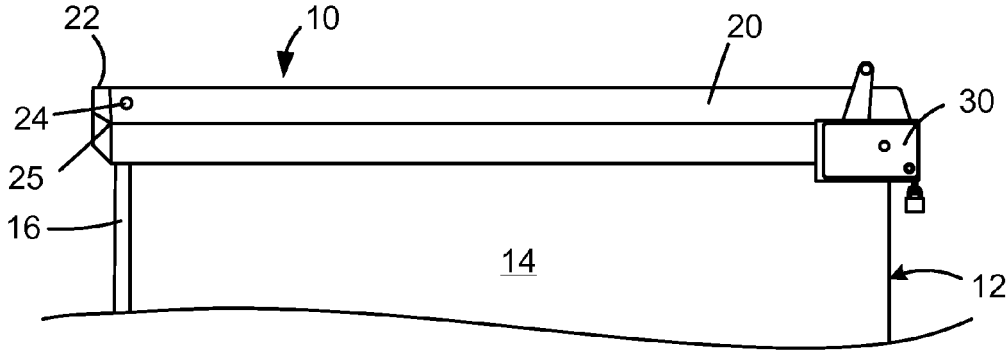
FIG. 2 is an elevational view, not to scale, of a bulk trash container including a gravity actuated locking mechanism mounted on a bulk trash container.

With reference to FIG. 1, a bulk trash container 10 is illustrated. The bulk trash container 10 may comprise a floor (not shown) and front 12, a left side wall 14, a rear side wall 16, and right side wall 18, each generally made from heavy duty metal and connected at the floor and along the edges of the neighboring side walls, defining an interior region 19 of the container 10. The container 10 may have a hinged lid 20, with a first end 22 pivotally attached by a hinge 24 to an upper edge 25 of the rear wall 16, and a free end 26 opposite the first end 22 that may be opened to access the interior 17 of the container 10. When closed, the free end 26 of the lid may rest upon an upper edge 27 of the front wall 12. The lid 20 may be pivoted about a hinge axis in order to open the container 10. When the container lid 20 is closed, it may be desirable for the lid 20 to be secured to prevent unauthorized access to the interior of the container 10, while at the same time allowing the container 10 to be opened for emptying its contents into an appropriate receptacle.

Embodiments of the present disclosure may relate to automatic gravity actuated lid locking mechanisms for bulk trash containers, also known as dumpsters. The mechanisms may be constructed from a durable material such as heavy duty metal. The mechanisms of the present disclosure may have a low-profile, that is, the mechanism components may remain proximal to the dumpster body in both the locked and the unlocked positions, and also during the transition between locked and unlocked positions. The low profile of the mechanism may prevent interference of the locking mechanism with any lifting mechanism used to empty the container of refuse.

Referring now to FIGS. 2-5, a gravity actuated locking mechanism 30 of the present disclosure is shown mounted on a bulk trash container 10 in a locked position. A locking mechanism 30 in accordance with the present disclosure may comprise an enclosed first housing 32 for mounting on a first exterior side wall 14 of a bulk refuse container 10. The first housing 32 may further comprise a pivotable actuator arm 34 extending from a top wall 32A of the first housing 32.

The locking mechanism 30 may further comprise a second enclosed housing 36 for mounting on a second exterior side wall 18 of a container 10. The second enclosed housing 36 may comprise a pivotable dummy arm 38 extending from a top wall 36A of the second housing 36.

The actuator arm 34 and the dummy arm 38 may be connected by a rigid crossbar member 40, and the two arms 34 and 38 may pivot between a locked and an unlocked position. The assembled crossbar 40, actuator arm 34, and dummy arm 38 may be collectively referred to as a locking bar assembly 42.

Figure 6A:
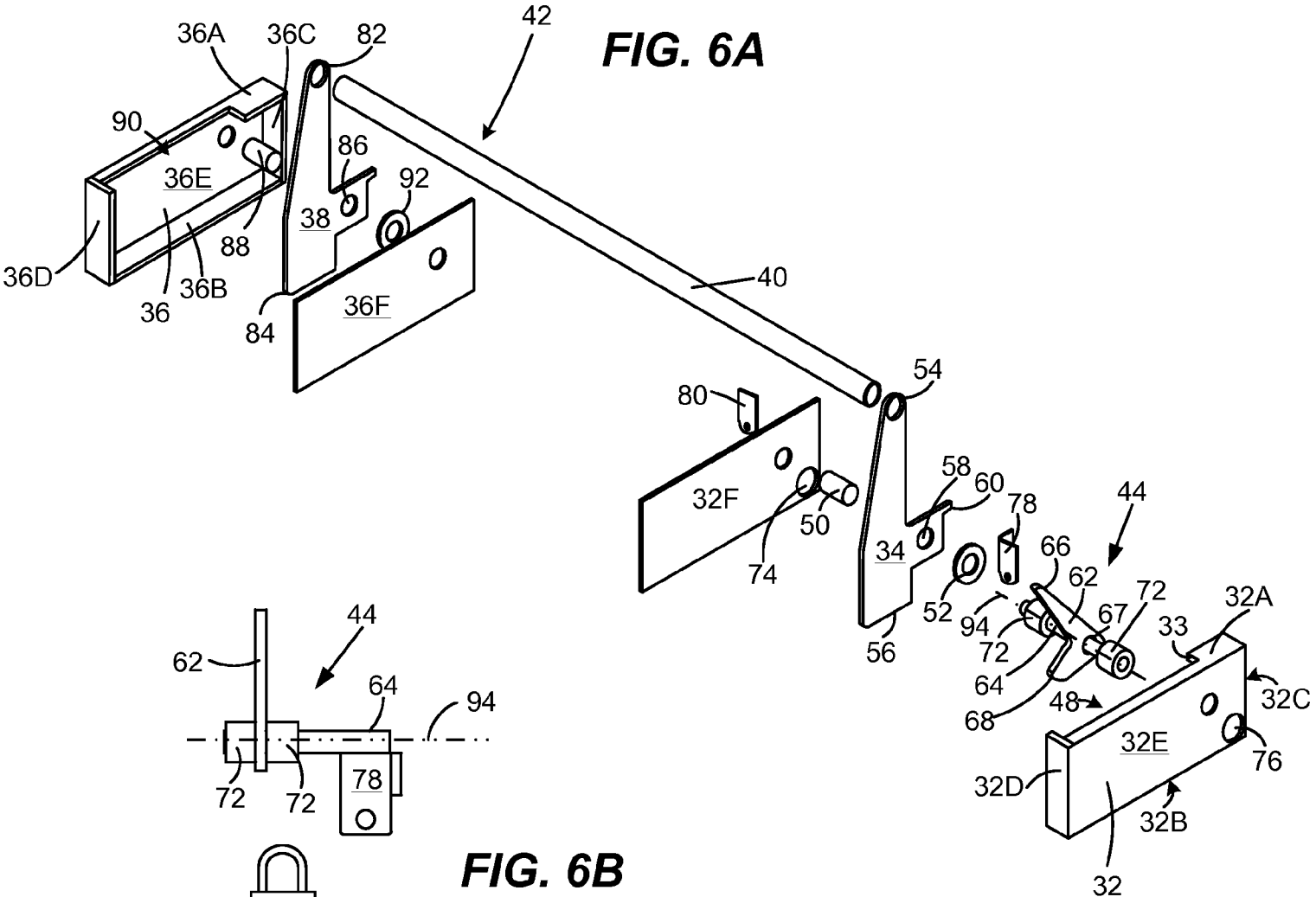
FIG. 6A is a perspective exploded view, not to scale, of a locking bar assembly according to the disclosure.
Figure 6B:
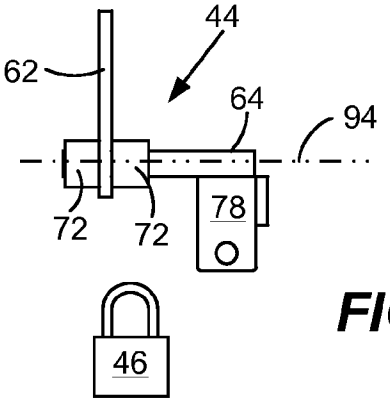
FIG. 6B is an elevational view, not to scale, of a locking pin assembly for a locking bar assembly according to the disclosure.

An exploded view of the locking bar assembly 42 is illustrated in FIG. 6A-B, showing details thereof. The first enclosed housing 32 may further comprise a manual unlocking mechanism, such as a pin assembly 44, that may be secured in the locked position by a lock 46, such as a padlock.

Figure 3:
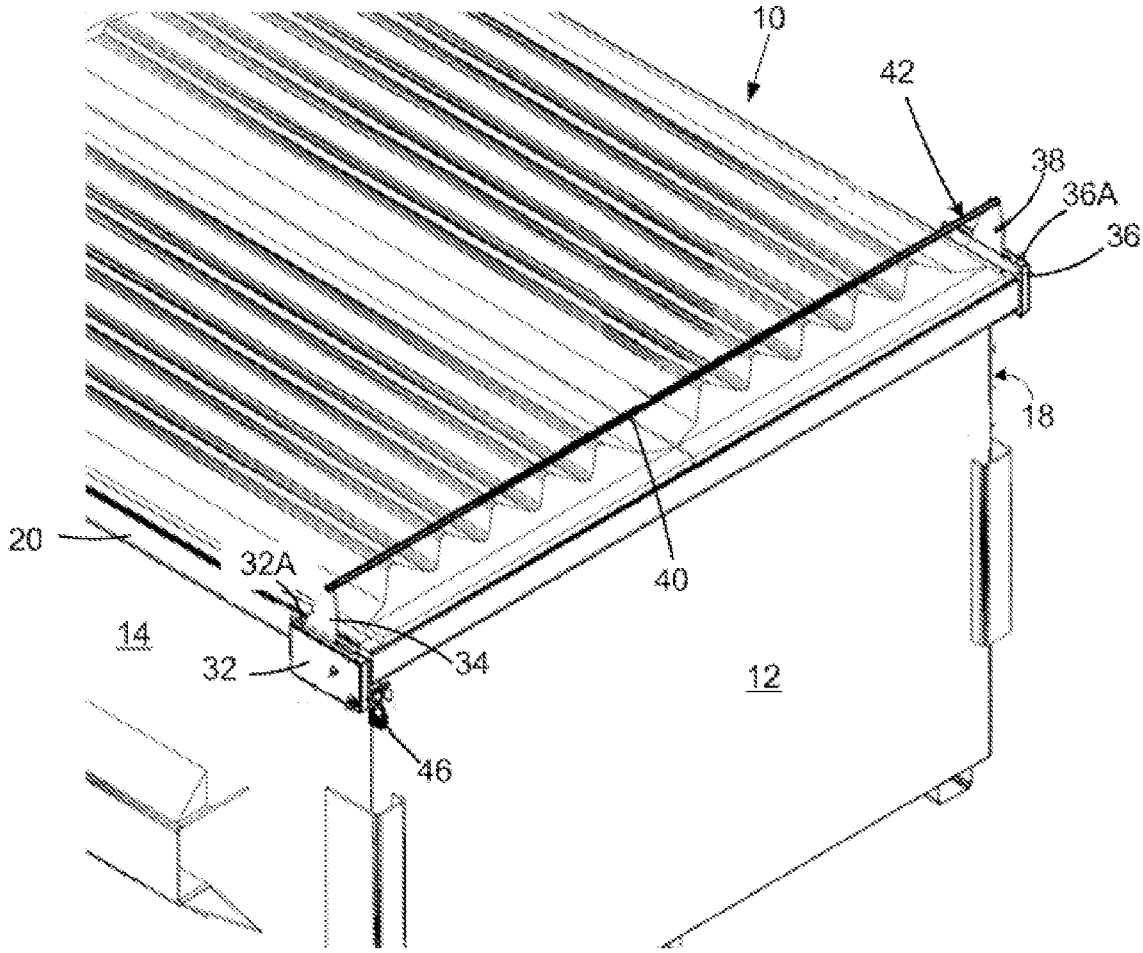
FIG. 3 is a partial perspective view, not to scale, of a gravity actuated locking mechanism for a bulk trash container, wherein the mechanism is shown in a locked position.

The enclosed housings 32 and 36 may be made of sufficiently durable material to prevent unauthorized tampering with the mechanism, or removal of all or part of the mechanism by an unauthorized person. The first and second enclosed housings 32 and 36 may be fixedly attached to the first and second walls 14 and 18 of the container 10 by any conventional means, including welding or bolting (FIG. 3).

The crossbar 40 of the locking bar assembly 42 may be positioned across the lid 20 of the container 10 so that the crossbar 40 may prevent the opening of the lid 20 of the container 10 by unauthorized users when the locking mechanism 30 is secured by the pin assembly 44 and the pin assembly 44 is padlocked in the locked position. When the locking bar assembly 42 is pivoted forward to the unlocked position, either by tilting the container 10 or after manually sliding the pin assembly 44 into an unlocked position, the lid 20 of the container 10 may be opened as described in more detail below.

With reference to FIG. 6A, each of the enclosed housings 32 and 36 include the top wall 32A or 36A, a bottom wall 32B or 36B, a front wall 32C or 36C, a rear wall 32D or 36D, and a side wall 32E or 36E. A plate member 32F and 36F completes the enclosed housings 32 and 36.

As described above, the first enclosed housing 32 has the top wall 32A and a first slot region 48 in the top wall 32A. The actuator arm 34 is pivotally mounted to the housing 32 on a first shaft 50. The actuator arm 34 may be pivotally secured to the shaft 50 in a substantially fixed position by a retainer ring 52 that may be press-fit or welded to the shaft 50. In a first embodiment, the shaft 50 may be fixedly attached to the housing 32 as by welding or other means known to those skilled in the art. In a second embodiment, the shaft 50 may be pivotally attached to the housing 32 by suitable means known to those skilled in the art.

Figure 4:
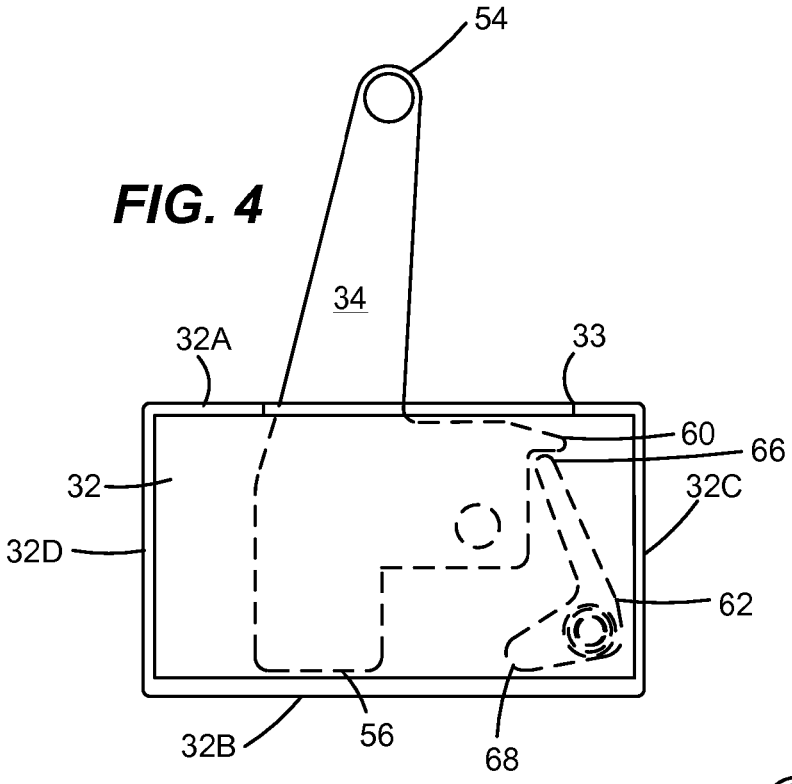
FIG. 4 is an elevational view, not to scale, of an actuator arm and housing for a locking mechanism according to the disclosure.
Figure 5:
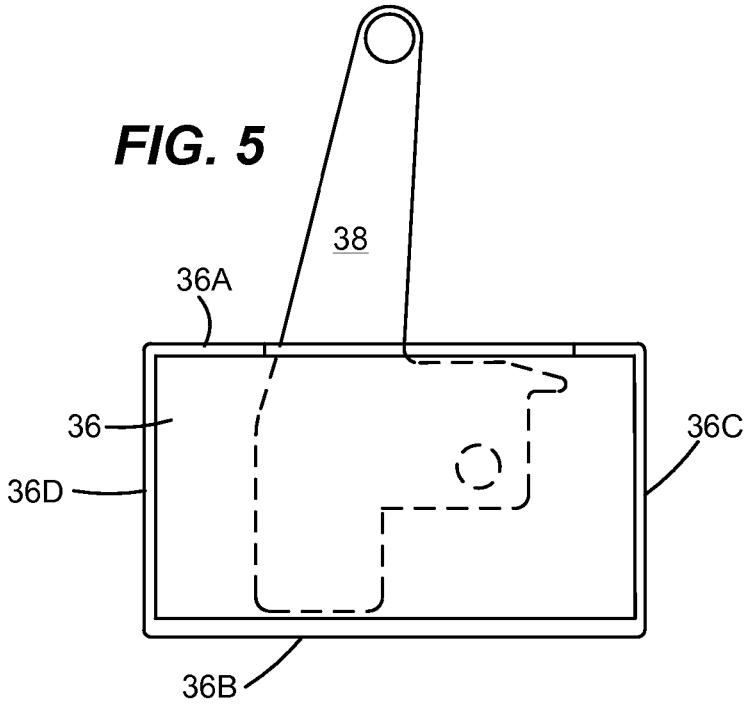
FIG. 5 is an elevational view, not to scale, of a dummy arm and housing for a locking mechanism according to the disclosure.

The first slot region 48 provides an opening in the top wall 32A for allowing pivotal motion of the actuator arm 34 about the shaft 50. A range of motion of the actuator arm 34 may be limited by one or more stops. For example, the actuator arm 34 may be prevented from pivoting in a first direction by a portion 33 of the top wall 32A of the first enclosed housing 32 and in a second direction by the bottom wall 32B of the housing 32 (FIG. 4). Other means, such as pins or flanges welded to the side wall 32E or plate 32F may be used to limit motion of the actuator arm 34.

The actuator arm 34 may comprise a first locking bar end 54, a first counterweighted end 56, a first pivot opening 58 for pivotal rotation about the first shaft 50, and a locking tab 60 offset from the first pivot opening between the counterweighted end 56 and the locking bar end 54 of the actuator arm 34.

Also provided within the first enclosed housing 32 may be a trigger means, such as an L-shaped locking arm 62 pivotally mounted to a second shaft 64. The L-shaped locking arm 62 may have a first end 66 and a second end 68 distal from the first end 66, and a second pivot opening 67 between the first end 66 and the second end 68. The L-shaped locking arm 62 may be pivotally attached to the second shaft 64 in a fixed lateral position along the shaft 64 by spacers 72. The spacers 72 may be fixedly attached to the shaft 64 on opposing sides of the L-shaped locking arm 62 to retain the arm 62 in a fixed position relative to the second shaft 64. The second shaft 64 may pass through a first manual lock opening 74 in the plate member 32F and through a corresponding opening 76 in the side wall 32E. The second shaft 64 may comprise a locking tab 78 that may be aligned with a fixed tab 80 attached to the plate member 32F. A hole may be provided in each of the locking tab 78 and the fixed tab 80 for attaching the lock 46, thereby preventing translational motion of the second shaft 64 through the openings 74 and 76.

The actuator arm 34 may be fixedly attached at the locking bar end 54 to one end an elongate member means, such as the rigid crossbar member 40. The other end of the rigid crossbar member 40 may be fixedly attached to a locking bar end 82 of a dummy actuator means, such as the dummy arm 38 that may extend from a top wall 36A of the second enclosed housing 36. The dummy arm 38 may further comprise a counterweighted end 84 and a pivot opening 86 located between the locking bar end 82 and the counterweighted end 84 for pivotal motion about the axis of a dummy shaft 88. The dummy shaft 88 may be fixedly attached to the plate member 36F and the side wall 36E. A slot 90 may be located in the top wall 36A of the enclosed housing 36 to provide a limited range of motion for the dummy arm 38. As with the actuator arm 34, the dummy arm 38 may be pivotally secured in a fixed lateral position on the dummy shaft 88 by a retainer ring 92, which may be press-fit or welded onto the dummy shaft 88. Alternatively, the dummy shaft may be fixed to the side wall 36E and plate member 36F so that the shaft 88 may rotate as described above with reference to shaft 50.

Figure 7A:
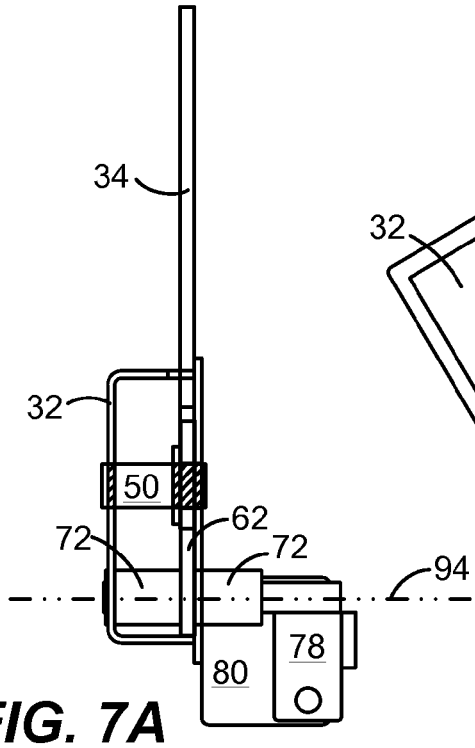
FIG. 7A is a front elevational view, not to scale, of an actuator arm for a locking bar assembly in a gravity locked position.

The assembled L-shaped arm 62, spacer rings 72, second shaft 64, and locking tab 60 may collectively be referred to as the pin assembly 44. When unlocked, the pin assembly 44 is capable of translational motion along an axis 94 (FIG. 6B) defined by the second shaft 64, through the openings 74 and 76 in the first enclosed housing 32. When in the locked position, the first end 66 of the L-shaped locking arm 62 may engage the locking tab 60 of the actuator arm 34, thereby preventing pivotal motion of the actuator arm 34 and the associated motion of the entire locking bar assembly 42. A cross-sectional view of the lock mechanism 30 is illustrate in FIG. 7A and for mechanism 30 in the gravity locked position.

Figure 7C:
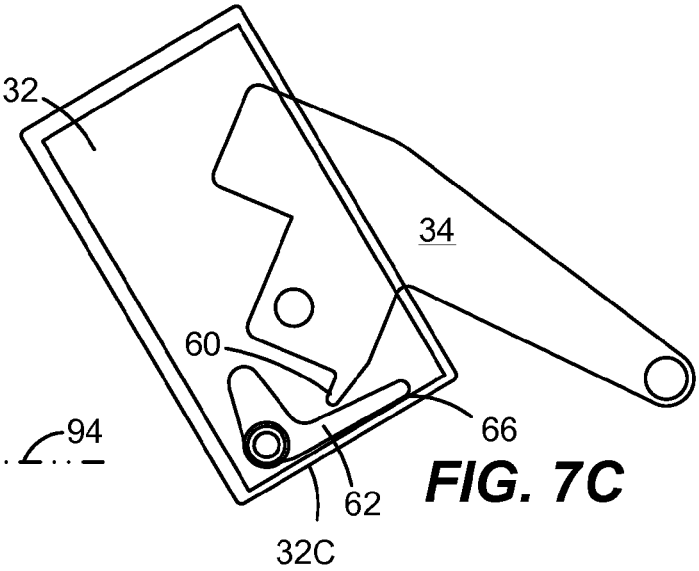
FIG. 7C is an elevational, schematic view, not to scale, of a an actuator arm for a locking bar assembly that is unlocked by gravity.
Figure 8:
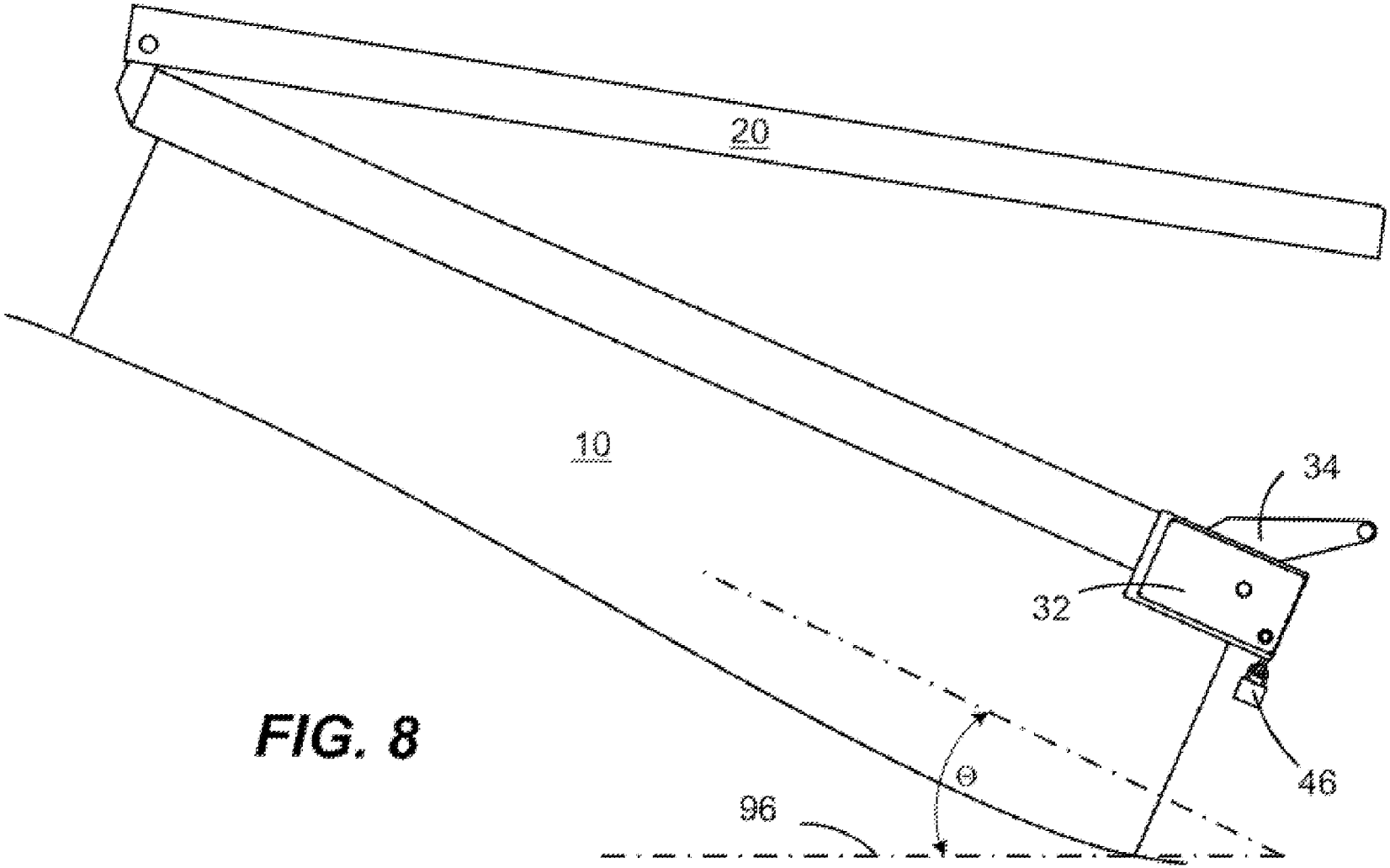
FIG. 8 is an elevational view, not to scale, of a locking bar assembly and trash container in a gravity unlocked position.

With reference to FIG. 8, upon tilting the trash container 10 to which the gravity actuated locking mechanism 30 may be attached, the locking bar assembly 42 may automatically be pivoted into an unlocked position by movement of the first end 66 of the L-shaped locking arm 62 toward the front wall 32C of the housing 32 as shown in FIG. 7C. The mechanism may be required to be tilted by an angle Θ at least about 25 degrees, relative to a horizontal plane 96 defined by an initial position of the container 10 on the ground, before the locking bar assembly 42 may be automatically unlocked.

The L-shaped arm 62 may be weighted so that as the gravity actuated locking mechanism 10 is tilted at least about 25 degrees from the horizontal plane 96, and desirably from about 30 to about 45 degrees, relative to the horizontal plane 96 described above, the L-shaped arm 62 may automatically pivot freely about the axis 94 of the second shaft 64 and disengage from the locking tab 60 of the actuator bar 34. The counterweighted actuator arm 34 may then pivot freely about the axis of the first shaft 50 so that the locking bar assembly 42 may freely move into the unlocked position shown in FIG. 8 from a locked position as illustrated in FIG. 3. As trash container 10 is tilted further, the actuator arm 34 may pivot about the axis of the first shaft 50 due to the effect of gravitational force on the cross bar member 40 of the locking bar assembly 42. The cross bar member 40 also may cause the dummy arm 38 to pivot about the dummy shaft 88.

Once the container is emptied, the container may be tilted back to the horizontal position. As the angle of the container is decreased, the counterweighted ends 56 and 84 of the actuator arm and dummy arm 34 and 38 cause the actuator arm and dummy arm to rotate in the opposite direction so that the locking bare assembly 42 is repositioned above the container lid 20. As the actuator arm rotates, the L-shaped arm 62 also rotates about the second shaft 64 so that the first end 66 re-engages the tab 60 of the actuator arm 34 thereby preventing unauthorized use of the container.

Figure 9A:
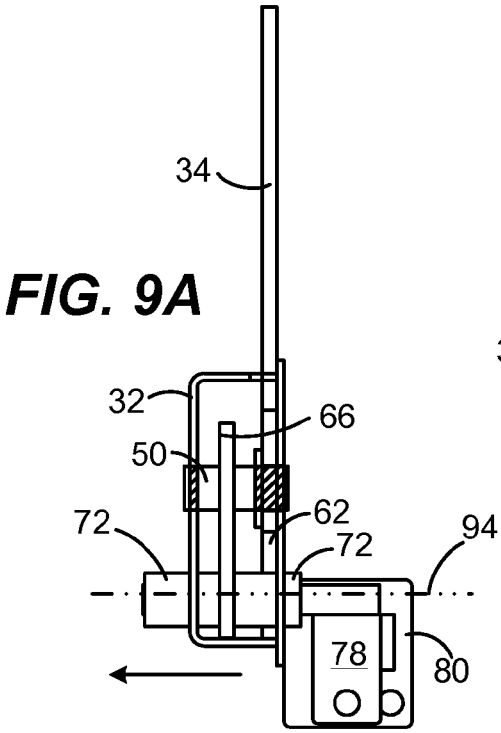
FIG. 9A is a front elevational view, not to scale, of an actuator arm for a locking bar assembly in a manual unlocked position.
Figure 9C:
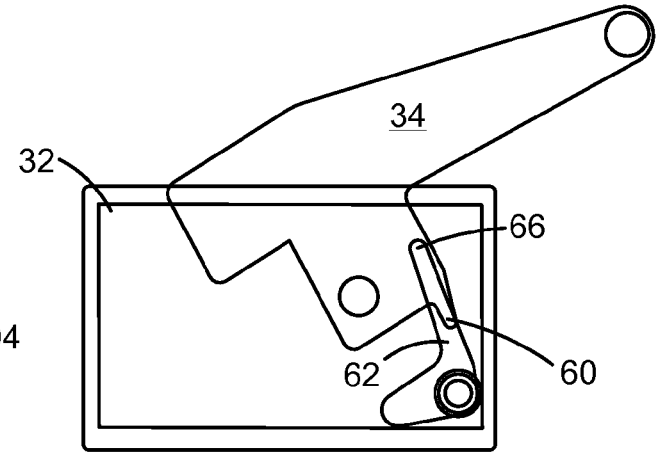
FIG. 9C is an elevational, schematic view, not to scale, of a an actuator arm for a locking bar assembly that is manually unlocked.
Figure 7B:
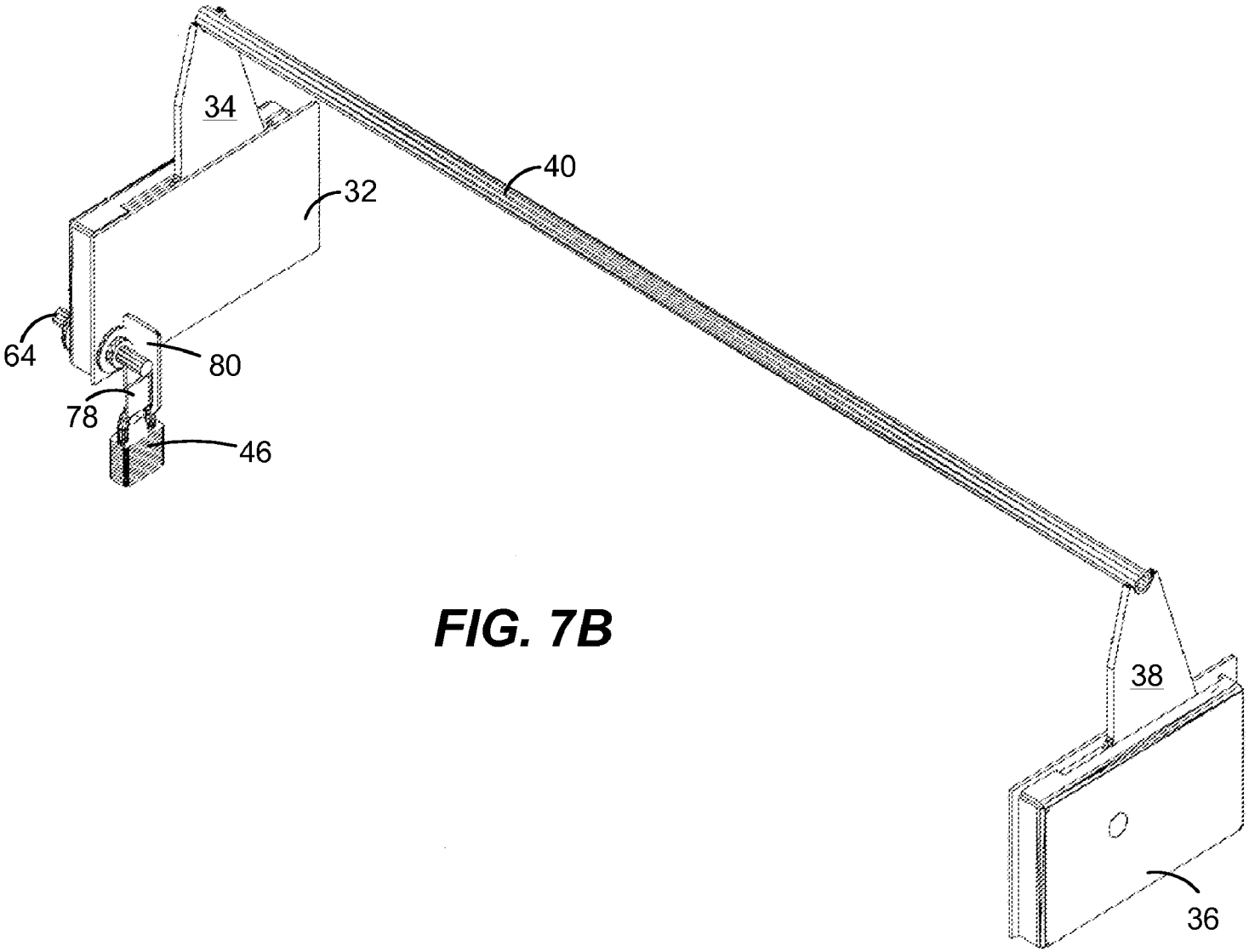
FIG. 7B is a perspective view, not to scale, of a locking bar assembly in a gravity locked position.
Figure 9B:
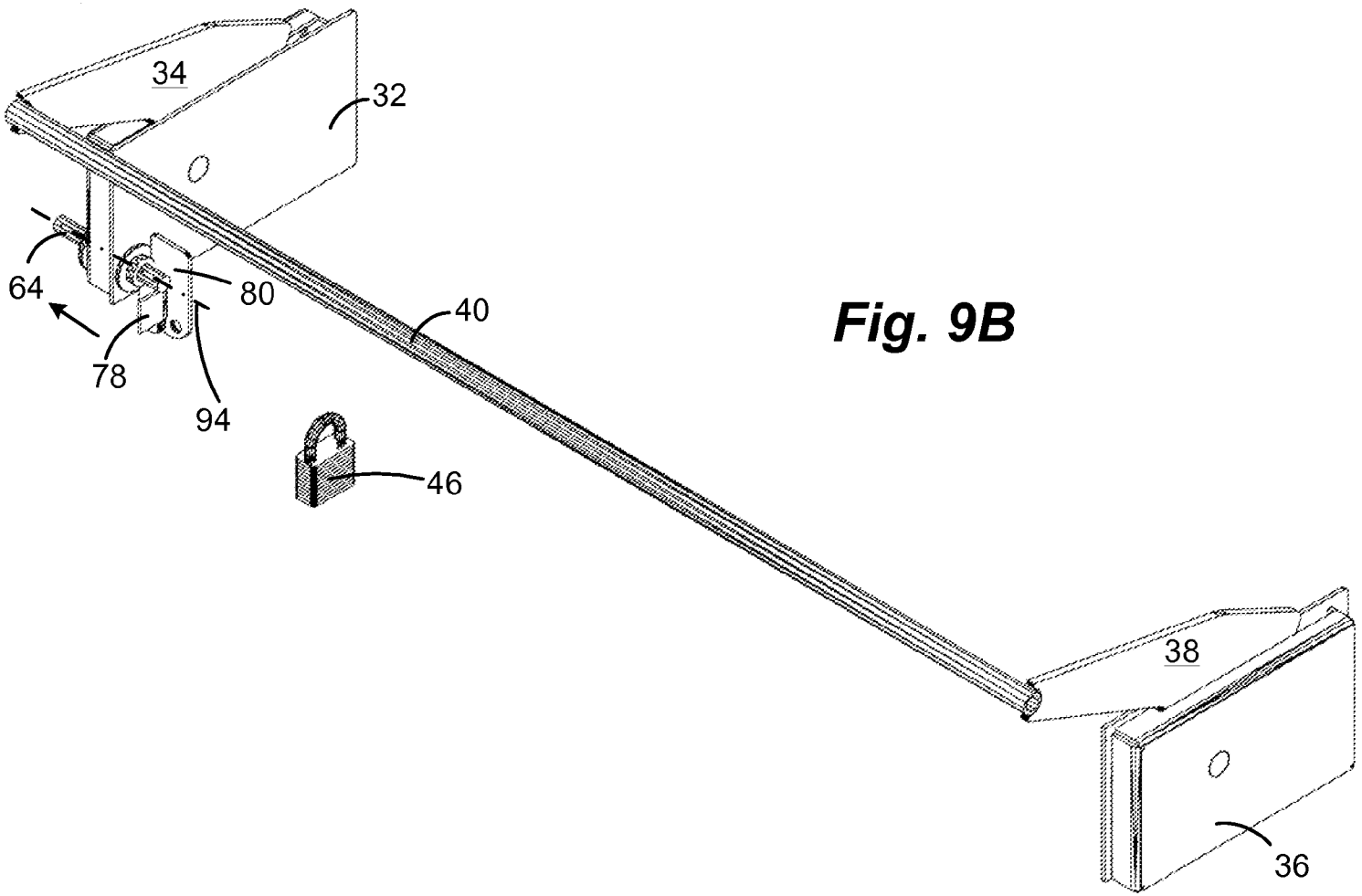
FIG. 9B is a perspective view, not to scale, of a locking bar assembly in a manual unlocked position.

With reference to FIGS. 9A-9C, the locking bar assembly 42 is shown in a manually unlocked position, with the pin assembly 44 shifted axially along the axis 94 of the second shaft 64 in the direction of the arrow to move the L-shaped locking arm 62 into a manually unlocked position. When the L-shaped arm 62 is shifted along the axis 94 of the second shaft 64, end 66 is disengaged from the locking tab 60 of the actuator arm 34. Accordingly, the actuator arm 34 may freely pivot about the first shaft 50 thereby allowing the locking bar assembly 42 to be pivoted by an authorized person to the unlocked position so that the container lid 20 may be opened. Manually shifting the pin assembly 44 laterally out of alignment with the actuator arm 34 has an added advantage of reducing the frictional interference between the actuator arm 34 and the pin assembly 44 so that the locking bar assembly 42 may be freely moved between the locked and unlocked positions. Likewise, when the pin assembly 44 is shifted and locked by padlock 46 into the gravity operated position shown in FIG. 7A, movement of the locking bar assembly 42 may only be obtained by tilting the trash container 10 as described above.

Other embodiments of the present disclosure will be apparent to those skilled in the art from consideration of the specification and practice of the embodiments disclosed herein. In particular, the locking mechanism of the present disclosure may be adapted for use with other types of containers or lids, for example a gravity actuated locking mechanism for a container having a sliding lid instead of a hinged lid.

As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A low profile locking mechanism for a refuse container lid comprising:

an enclosed first housing for mounting on a side wall of a refuse container, the enclosed first housing including:

an actuator arm extending through a top wall of the first housing, the actuator arm having a first counterweighted end, a first locking bar end opposite the first counterweighted end, a first pivot opening for pivotal rotation about a first shaft, and a locking tab offset from the first pivot opening between the counterweighted end and the locking bar end;

a second shaft disposed through the housing, the second shaft having rotational movement about an axis and translational movement along the axis, wherein the second shaft includes a first locking tab having a first opening therein and the housing includes a second locking tab having a second opening therein for locking the second shaft against translational movement when a locking member is placed into the openings of the first and second tabs; and an L-shaped locking arm enclosed in the housing and pivotally attached to the second shaft for engaging the locking tab of the actuator arm to prevent rotation of the actuator arm, the locking arm having a first end, a second end distal from the first end, and a second pivot opening between the first end and the second end;

wherein the locking arm is pivoted by gravity about the second shaft from a locked position to an unlocked position upon tilting the container at least about 25 degrees.

2. The locking mechanism of claim 1, wherein the second shaft is locked against translational movement with a padlock disposed in the first and second openings.

3. The locking mechanism of claim 1, wherein the first housing comprises a first stop for engaging the actuator arm in first position, and a second stop for engaging the actuator arm in a second position.

4. The locking mechanism of claim 3, wherein the first housing comprises a third stop for engaging the locking arm in an unlocked position.

5. The locking mechanism of claim 1, further comprising a second housing for mounting on an opposite side wall of the container, the second housing including:

a pivot arm extending through a top wall of the second housing, the pivot arm having a second counterweighted end, a second locking bar end opposite the second counterweighted end, and a pivot opening for pivotal rotation about a shaft; and a locking bar attached to the second locking bar end of the pivot arm and to the first locking bar end of the actuator arm so that the locking bar is disposed adjacent to and above a portion of the lid of the container when the locking mechanism is in a locked position and the locking bar is disposed forward of the lid of the container when the locking mechanism is in the unlocked position.

6. The locking mechanism of claim 5, wherein the locking arm in the unlocked position disposed forward of the lid of the container no more than about six inches.

7. A gravity operated trigger lock mechanism for locking a refuse container lid for a container, the trigger lock mechanism comprising:

a first housing attached to a first side wall of the container, the first housing including an actuator arm pivotally attached to the housing and a gravity operated trigger mechanism pivotally disposed in the housing for engaging a tab on the actuator arm so that when the container is tilted at least about 25 degrees, gravity causes the trigger mechanism to pivot and disengage from the tab on the actuator arm, wherein the trigger mechanism is pivotally disposed on a translatable shaft disposed in the first housing for moving the trigger mechanism into and out of an actuator locking position;

a second housing attached to an opposing side wall of the container, the second housing including a pivot arm attached to the housing;

and a locking bar attached to the actuator arm and to the pivot arm, wherein the locking bar is disposed over a portion of the lid in a locked position and is disposed forward of the lid in an unlocked position.

8. The lock mechanism of claim 7, wherein the trigger mechanism comprises an L-shaped latch.

9. The lock mechanism of claim 7, wherein the translatable shaft includes a first locking tab having a first opening therein and the first housing includes a second locking tab having a second opening therein for locking the translatable shaft against translational movement with a padlock disposed in the first and second openings.

10. The lock mechanism of claim 7, wherein the first housing comprises a first stop for engaging the actuator arm in first position, and a second stop for engaging the actuator arm in a second position.

11. The lock mechanism of claim 10, wherein the first housing comprises a third stop for engaging the trigger mechanism in a tripped position.

12. A gravity operated container lid hold down device, comprising:

a first housing structure attached to a first side wall of a container, the first housing structure including:

an actuator means for pivotal movement on a first shaft attached to the first housing structure between a lid hold down position and a lid opening position;

a trigger means pivotally disposed on a translatable shaft disposed through the housing for moving the trigger means into and out of engagement with the actuator means and for pivotal movement of the trigger means by gravity into and out of engagement with the actuator means for permitting movement of the actuator means from the lid hold down position to the lid opening position as the container is tilted at least about 25 degrees;

a second housing structure attached to a second side wall of a container, the second housing structure including:

a dummy actuator means for pivotal movement on a third shaft attached to the second housing structure between the lid hold down position and the lid opening position; and an elongate member means attached to the actuator means and the dummy actuator means so that the elongate member is disposed from the first side of the container to the second side of the container across the lid.

13. The hold down device of claim 12, wherein the trigger means comprises an L-shaped latch.

14. The hold down device of claim 12, further comprising a locking means attached to the translatable shaft and to the first housing for locking the translatable shaft against translational movement.

15. The hold down device of claim 12, wherein the first housing comprises stop means on the first housing for the actuator means.

* * * * *